US005450980A

United States Patent [19]

Laidlaw

[11] Patent Number: 5,450,980

[45] Date of Patent: Sep. 19, 1995

[54] COIN OPERATED VENDING MACHINE FOR VENDING INDIVIDUAL CIGARETTES FROM A CIGARETTE MANUFACTURER'S CONTAINER

[76] Inventor: Ronald W. Laidlaw, 8790 E. Lupine Dr., Scottsdale, Ariz. 85260

[21] Appl. No.: 138,685

[22] Filed: Oct. 18, 1993

Related U.S. Application Data

[63] Continuation-in-part of Ser. No. 967,788, Oct. 28, 1992, Pat. No. 5,351,856, and Ser. No. 138,459, Oct. 15, 1993.

[51] Int. Cl.[6] ..... G07F 11/44; A24F 15/04

[52] U.S. Cl. ..... 221/1; 221/197; 221/203; 221/266

[58] Field of Search ..... 194/255, 350; 221/131, 221/197, 198, 203, 207, 266, 281, 1; 312/42, 45, 73; 206/242

[56] References Cited

U.S. PATENT DOCUMENTS

| | | | |
|---|---|---|---|
| 471,053 | 3/1892 | Henry | 221/266 |
| 1,426,792 | 8/1922 | Vallens | 206/242 |
| 1,490,365 | 4/1924 | DuGrenier | 221/207 X |
| 1,795,117 | 3/1931 | Green | 194/255 |
| 1,986,658 | 1/1935 | Witter | 221/197 |
| 2,923,437 | 2/1960 | Miller | 221/266 |
| 3,960,299 | 6/1976 | Hollinger | 222/559 |
| 4,184,591 | 1/1980 | Geldmacher | 206/265 |
| 4,190,145 | 2/1980 | Paret | 194/1 |
| 4,220,256 | 9/1980 | Torri | 221/147 |
| 4,676,399 | 6/1987 | Burckhardt | 221/207 |
| 4,679,684 | 7/1987 | Glaser | 194/350 |
| 4,850,511 | 7/1989 | Kral et al. | 312/42 X |
| 4,852,767 | 8/1989 | Humphrey | 221/241 |
| 4,928,817 | 5/1990 | Focke | 206/256 |
| 5,005,698 | 4/1991 | Mikhail | 206/257 |
| 5,067,634 | 11/1991 | Vidondo | 221/298 |
| 5,113,879 | 5/1992 | Alleon | 131/329 |

FOREIGN PATENT DOCUMENTS

| | | | |
|---|---|---|---|
| 1-171086 | 7/1989 | Japan | 221/281 |
| 1529387 | 10/1978 | United Kingdom | 221/203 |

*Primary Examiner*—F. J. Bartuska
*Attorney, Agent, or Firm*—H. Gordon Shields

[57] ABSTRACT

A small, wall mounted, coin operated vending machine vends individual tubed cigarettes directly from a cigarette manufacturer's original cigarette container. The machine has a removable hopper for loading and holding the cartons of tubed cigarettes. The cigarettes in the hopper are picked up one at a time in a slot of a dispensing member that is rotated by the coin mechanism. The dispensing member may have a plurality of slots to allow for the dispensing of a predetermined number of tubed cigarettes for each turn of the coin mechanism. Agitators may be placed on the dispenser to insure proper feeding of cigarettes into a dispenser slot. The coin mechanism may also be adapted to use tokens only. A "cheater" feature prevents dispensing of more cigarettes than have been properly purchased.

24 Claims, 4 Drawing Sheets

COIN OPERATED VENDING MACHINE FOR VENDING INDIVIDUAL CIGARETTES FROM A CIGARETTE MANUFACTURER'S CONTAINER

This is a continuation-in-part application of applications Ser. No. 07/967,788 filed Oct. 28, 1992 now Pat. No. 5,351,856, and Ser. No. 08/138,459 filed Oct. 15, 1993.

BACKGROUND OF THE INVENTION

1. Fields of the Invention

The present invention relates generally to vending machines, and more particularly, to coin-operated vending machines that dispense a predetermined number of individual cigarettes directly from a cigarette manufacturer's container. Each cigarette in the container may be in an individual tube.

2. Discussion of Background and Prior Art

Many cigarette vending machines presently exist on the market. However, the demand for cigarette machines has been decreasing due to social pressures, health factors, and other concerns. Moreover, cigarette pack costs have increased to the point such that people are not as inclined to purchase their cigarettes from a machine, especially since they risk putting several dollars into a possibly broken or defective machine that may not deliver the purchased cigarette pack. Most conventional cigarette pack vending machines are complicated, expensive, and massive devices. They offer customers an exceedingly large selection of cigarette brands, and they include complicated and expensive coin and bill changers for handling large bill purchases. These machines require a large amount of floor space and electrical outlets for their operation.

Vending machines that dispense cigarettes individually, therefore, have been used to overcome some of the disadvantages with cigarette pack vending machines. One advantage of an individual cigarette vending machine is that a customer does not have to risk putting several dollars into the machine to purchase individual cigarettes. Additionally, many part-time smokers who may be trying to quit or reduce their smoking, wish to only have a single cigarette at a time. Therefore, these single cigarette vending machines allow these part-time smokers to acquire only a single cigarette at a time. This advantage frees them from the temptations of a readily available stock of cigarettes and also frees them from having to beg their friends and acquaintances for a single cigarette.

Under federal laws and regulations (i.e. 26 U.S.C. §5751(a)(3) and 27 C.F.R. §296.166), cigarettes that are sold either through a retainer or vending machine must be in proper packages that bear the required marks or notices. Generally, cigarettes and other tobacco products may be sold from these packages provided that the products remain in the packages until removed by the customer or in the presence of the customer. The problem with most prior art single cigarette vending machines is that the cigarettes quickly become stale because they are removed from the original proper packages and are loaded into the machines in the absence of the customers. Presently, a single cigarette vending machine, which vends each cigarette directly from the proper and original manufacturer's carton or package in the presence of the customer, does not exist on the market.

Cigarettes are also soft, spongy, and extremely light weight when compared with most items typically dispensed in vending machines, and the lightweight, spongy nature of cigarettes cause them to quickly become stale and to misalign or jam together if dispensed through a conventional vending machine. Furthermore, sanitary conditions require loading cigarettes into a vending machine through the use of minimal human effort. A loading box for loading cigarettes into a single cigarette vending machine was disclosed by Mr. Ronald Laidlaw in his copending patent application entitled "VENDING MACHINE FOR INDIVIDUAL CIGARETTES" Ser. No. 07,967,788 filed on Oct. 28, 1992. The problem with the use of this loading box, however, is that cigarettes must be removed from the original proper packages in the absence of the customers, and this removal process gives rise to the problems discussed earlier. Therefore, a vending machine that dispenses individual cigarettes directly from the original manufacturer's container is desired.

Another problem with prior art individual cigarettes vending machines is that either the cigarettes have to be packaged or tubed prior to loading them into the machine, which gives rise to the package removal problems that were discussed earlier, or the cigarettes have to be dispensed without any tubing, packaging, or wrapping which causes them to quickly become stale. The dispensing of tubed cigarettes is desired since it has sanitary and freshness advantages. A cigarette dispensing apparatus is disclosed in U.S. Pat. No. 4,190,140 to Paret. This apparatus vends, and dispenses individually packaged or tubed cigarettes, but the disclosure does not mention how the cigarettes are placed into the tubes, nor the dispensing of tubed cigarettes from the original manufacturer's carton or package in which the cigarettes were purchased, nor the vending of individually tubed cigarettes from the original carton or package in the presence of the customer. A cigarette pack or box containing individually wrapped cigarettes has been disclosed in U.S. Pat. No. 5,005,698 to Mikhail, but these cigarettes are dispensed manually by tearing them from the other individually wrapped cigarettes in the box. A process for tubing individual cigarettes so that they may be dispensed from the original manufacturer's container in individual, single, rigid, plastic tube packages which are sufficiently airtight to maintain freshness is disclosed in a pending patent application entitled "PROCESS AND APPARATUS FOR AUTOMATICALLY INSERTING CIGARETTES INTO PLASTIC TUBES" filed, Ser. No. 08/138,459 by inventor, Mr. Ronald Laidlaw on Oct. 15, 1993. Presently, a cigarette vending machine in which the original cigarette cartons with individual cigarettes are loaded into the machine and dispensed directly from these original cartons in the presence of the customer, does not exist on the market.

Further limitations and problems with individual cigarette vending machines relate to the dispensing mechanisms of these machines. One problem is that these prior art machines are limited to dispensing only one cigarette for each set of coins or tokens that are inserted and rotated in the coin mechanism of the machine. Some prior art machines have multiple slots for the dispensing member, but all of these machines are still limited to dispensing one cigarette for each turn of the coin mechanism. Presently, a cigarette vending machine that has the option of being able to vend either a single or a plurality of cigarettes for each turn of the coin or mechanism, does not exist on the market.

Another problem is that some prior art machines have dispensing members that have agitators, but none of these machines provide notches or grooves to accommodate the agitators for the easy rotation of the dispensing member. Presently, a single vending cigarette machine that provides notches or grooves to accommodate the agitators for easy rotation of the dispensing member, does not exist on the market.

Some prior art machines have a further problem in that multiple cigarettes are dispensed without inserting additional coins or tokens because of design problems with the dispenser or vendor. Presently, a single vending machine that is designed so that multiple cigarettes are dispensed without inserting additional coins or tokens is desired.

A problem that generally exists with cigarette vending machines is that they may be more accessible to minors under the age of 18 years old, who may illegally purchase cigarettes from these machines. Therefore, tokens have been designed for and used in these machines to prevent this problem. These tokens must be purchased from the proprietor of the business where the vending machine is located, and the proprietor can, in effect, regulate the sale of the cigarettes from the machine. An additional advantage of designing the machines to use tokens only is that they become independent of the currency that is used, and this advantage makes the machine more marketable in other countries.

Therefore, it is an object of the present invention to overcome the problems and limitations of the prior art that have just been discussed above.

SUMMARY OF THE INVENTION

Set forth below is a brief summary of the invention in order to solve the foregoing problems and achieve the foregoing and other objects, benefits, and advantages in accordance with the purposes of the present invention as embodied and broadly described herein.

Accordingly, it is an object and advantage of the present invention to provide an improved cigarette vending machine.

It is one aspect and advantage of the present invention to provide a vending machine and process of vending that dispenses individual cigarettes directly from the cigarette manufacturer's original container.

It is another aspect and advantage of the present invention to provide a vending machine that dispenses individual cigarettes in which the original cigarette cartons are loaded into the machine and individual cigarettes are dispensed directly from the OEM cartons in the machine in the presence of the customer.

It is another aspect and advantage of the present invention to provide a vending machine that dispenses individual cigarettes in individual airtight tubes directly from the cigarette manufacturer's original container.

Another aspect of the present invention is a coin-operated cigarette vending machine which includes a support plate, at least one pair of brackets mounted to the support plate, a hopper slidably received in the at least one pair of brackets, a cigarette manufacturer's original cigarette carton in which tubed cigarettes are loaded in a horizontal orientation received in the hopper and having an open side, a rotatable dispensing member mounted in the hopper in the horizontal orientation for receiving tubed cigarettes from the open side of the carton and for dispensing the individually tubed cigarettes, a coin mechanism coupled to the dispensing member for generally locking its rotation and for allowing it to be rotated once when a required number of coins are inserted into the mechanism, and a coin container for holding and securing the coins inserted into the machine.

It is another aspect and advantage of the present invention to provide a vending machine that dispenses individual cigarettes that have an improved dispensing mechanism.

It is another aspect and advantage of the present invention to provide a vending machine that dispenses individual cigarettes that uses tokens instead of normal currency or coins.

It is another advantage of the present invention to provide a vending machine that dispenses individual cigarettes that is lightweight, small, and does not require electricity.

It is yet another advantage of the present invention to provide a vending machine that dispenses individual cigarettes that relies on gravity to reliably feed cigarettes into a dispensing mechanism.

It is still another advantage of the present invention to provide a vending machine that dispenses individual cigarettes in which cigarettes can be loaded and dispensed in a sanitary manner.

DETAILED DESCRIPTION OF THE PREFERRED EMBODIMENT

Figure 1:
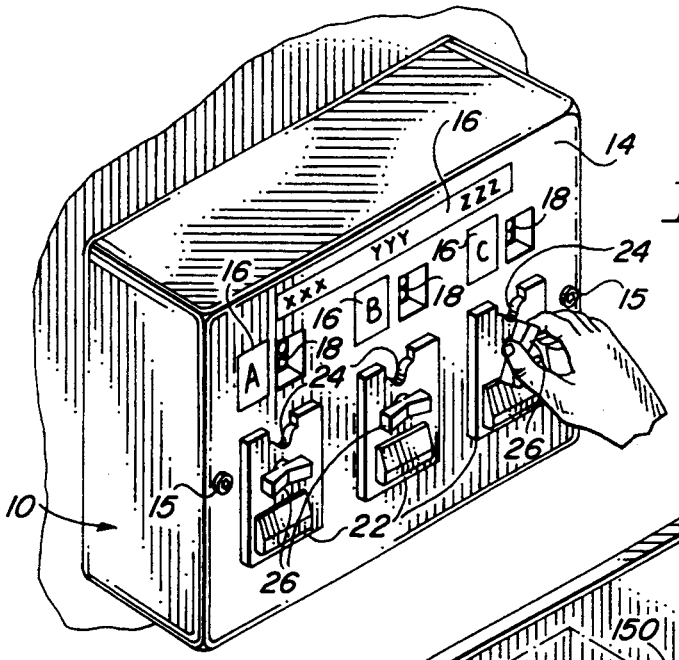
FIG. 1-Perspective view of the preferred embodiment of a vending machine that dispenses individual cigarettes.

FIG. 1 shows a perspective view of a single cigarette vending machine 10 that dispenses individual cigarettes constructed in accordance with a preferred embodiment of the present invention. Vending machine 10 is a relatively small, lightweight machine, constructed primarily of plastic, and is mountable on a building wall 12 (i.e. approximately three to five feet above a floor). Vending machine 10, therefore, does not occupy a significant amount of space.

Vending machine 10 includes an outer casing 14. Outer casing 14 is located in place through key-operated locks 15. Printed matter 16, which identifies brands of cigarettes dispensed by vending machine 10, is placed on the outer casing 14. Printed matter 16 may also include warning labels and any other pertinent information that is required or desired at a particular location.

Viewing windows 18 allow the stock of airtight tubed cigarettes 20 to be monitored or observed by either a person who refills the stock of cigarettes or a customer who wishes to purchase a cigarette. Window 18 provides the advantage of allowing the customer to check the supply of cigarettes before he inserts his money into the machine.

Figure 2:
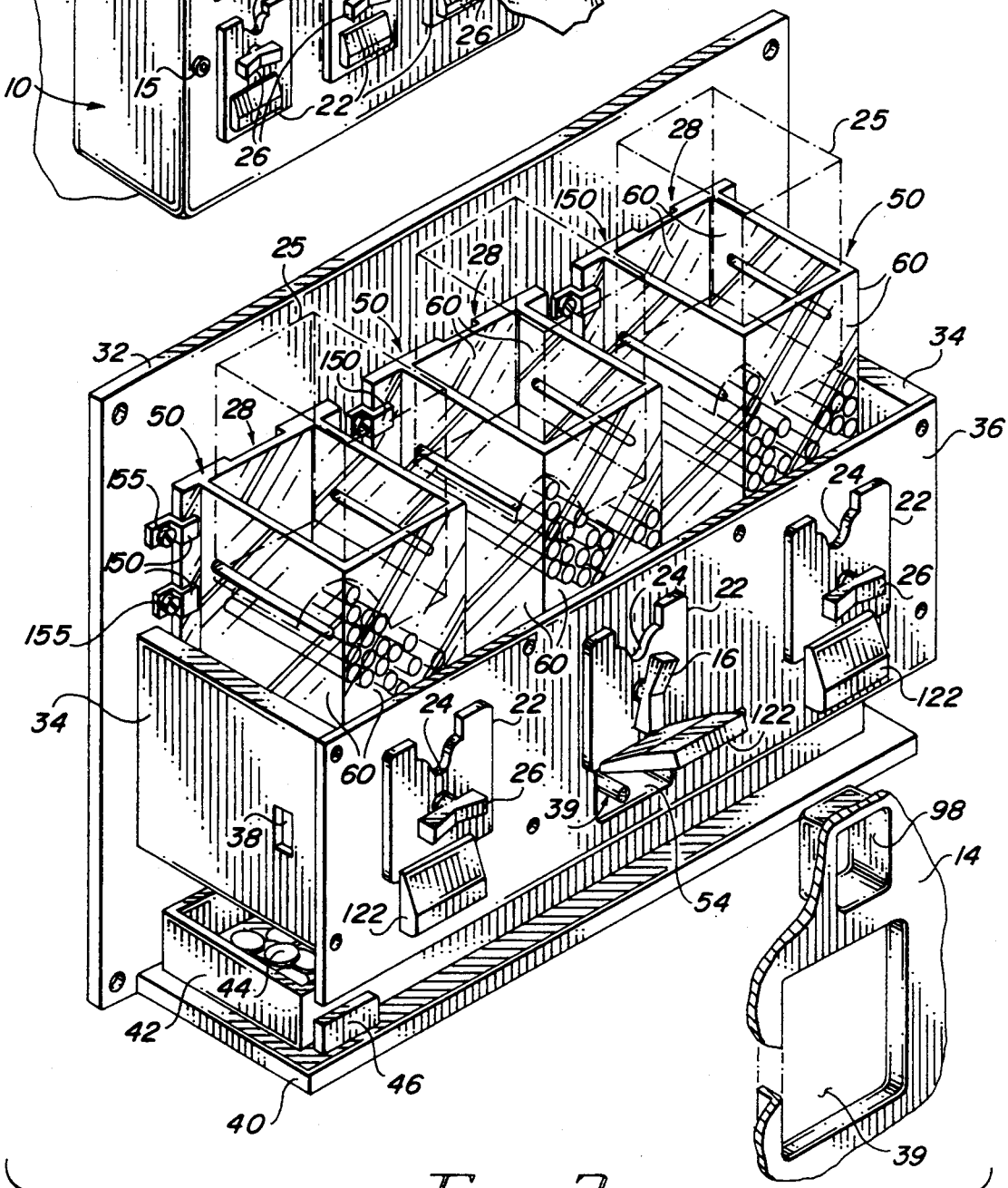
FIG. 2-Perspective view of the internal components of the preferred embodiment vending machine in FIG. 1.

Referring to FIGS. 1 and 2, vending machine 10 includes coin mechanisms 22, which extend through outer casing 14. Coin mechanisms 22 are conventional, coin mechanisms, and each coin mechanism 22 has a coin slot 24 and a handle 26. Prior to insertion of a coin or coins into coin slot 24, coin mechanism 22 is in a locked condition, and handle 26 cannot be rotated. However, upon the insertion of a coin or coins in coin slot 24, a customer can then turn handle 26 in a single direction, (i.e. clockwise in the preferred embodiment). This rotational motion causes vending machine 10 to dispense an individual cigarette 20 directly form a cigarette manufacturer's original container 25 (i.e. FIG. 9), as is discussed below.

Coin mechanism 22 is typically designed to accept quarters only and the machine does not provide any change. Lightweight and reliable examples of such mechanisms may be manufactured inexpensively. For example, the currently preferred embodiment of vending machine 10 uses a coin mechanism 22 sold under the Ultra Vend trade name by Innovative Design, Inc. of Idaho Falls, Id. Since these coin mechanisms are known in the art, they are not discussed in detail hereinafter.

Figure 3:
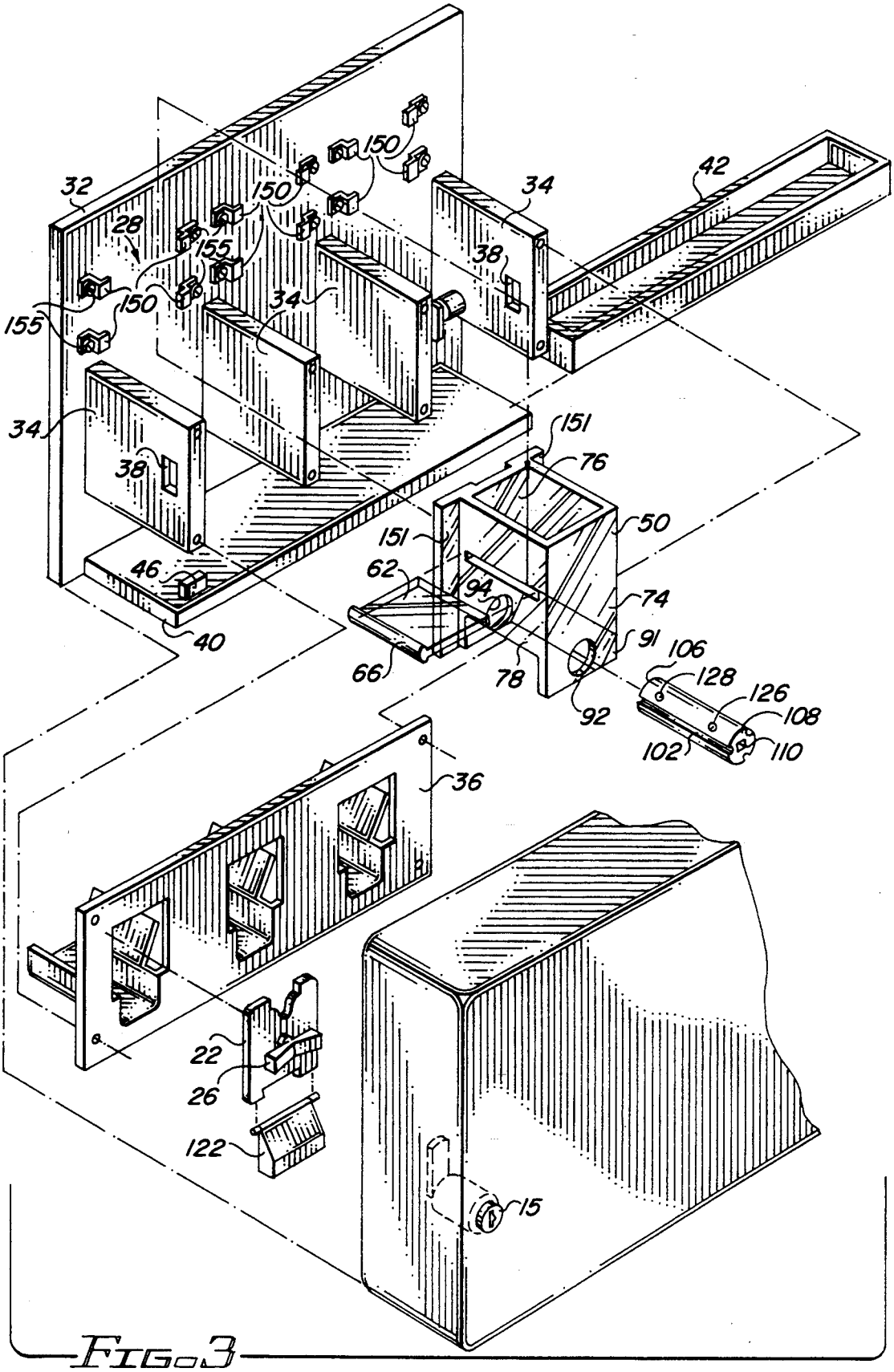
FIG. 3-Exploded view showing various components of the preferred embodiment vending machine.

FIG. 2 shows a perspective view of the internal components of vending machine 10, and FIG. 3 shows an exploded view of vending machine 10. In FIG. 2, vending machine 10 is shown to have three independent vendors 28, and FIG. 3 shows only one of these vendors 28 for illustration.

The Vendors

Any number of vendors 28 may be used on a single vending machine 10, but as the number of vendors 28 used increases, the size, weight, and cost of vending machine 10 also increases, but on the other hand, as the number of vendors 28 used increases, the product selection offered to customers also increases. By using three vendors 28, one vendor 28 may dispense menthol cigarettes, another vendor 28 may dispense filtered cigarettes, and yet another vendor 28 may dispense unfiltered cigarettes. Alternatively, different vendors 28 may simply dispense different sizes or brands of cigarettes 20. The need for offering additional product selection is believed to be of reduced importance to individual cigarette purchasers because they are typically less committed to smoking, than cigarette pack purchasers. Additionally, a machine 10 with a greater number of vendors 28 has the advantage in that if one of the vendors 28 malfunctions, customers may still obtain cigarettes 20 through the other vendors 28.

As seen in FIG. 3, vendors 28 are supported by a back plate 32, a plurality of side supports 34, and a front plate 36. As seen in FIG. 1, back plate 32 attaches to building wall 12. Side supports 34 extend between back plate 32 and front plate 36 and securely attach to both back plate 32 and front plate 36. In FIG. 3, the preferred embodiment is shown to have four side supports 34 so that an individual compartment is formed for each vendor 28 and so that adequate bracing is provided for front plate 36. The outer side supports 34 include holes 38, which cooperate with locks 15 to securely attach outer casing 14. Coin mechanisms 22 securely attach to front plate 36. As seen in FIG. 2, each coin mechanism 22 is accessible from the outside of outer casing 14 through an opening 39 therein.

A shelf 40 extends outwardly from back plate 32 underneath side supports 34 and front plate 36. A coin box 42 sits on shelf 40 and extends under each of vendors 28 to catch coins 44 passed through coin mechanisms 22. Coin box 42 is retained in place by stop 46, located on one end of shelf 40, and a lock 48 loaded near the other end of shelf 40. Stop 46 and lock 48 trap box 42 against back plate 32.

The Removable Hopper

Figure 6:
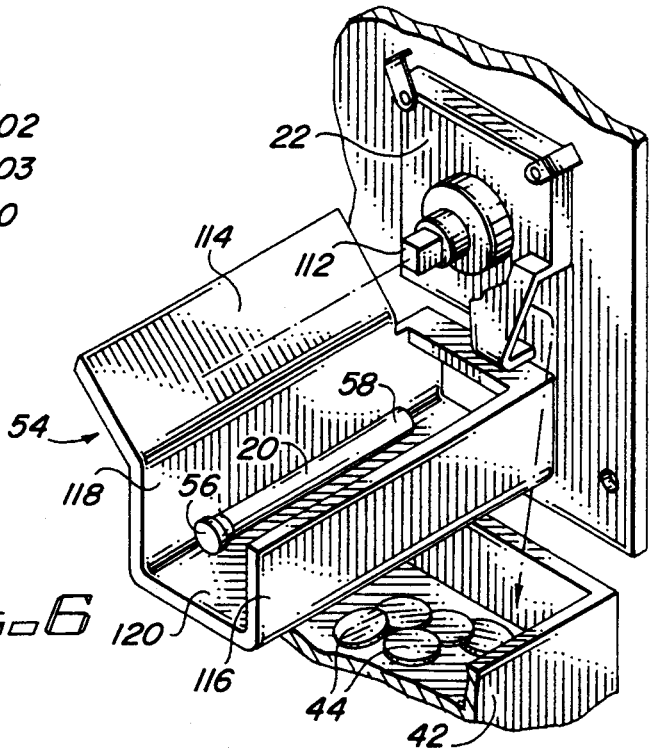
FIG. 6-Partial perspective view of a dispensing tray portion of the vending machine.
Figure 9:
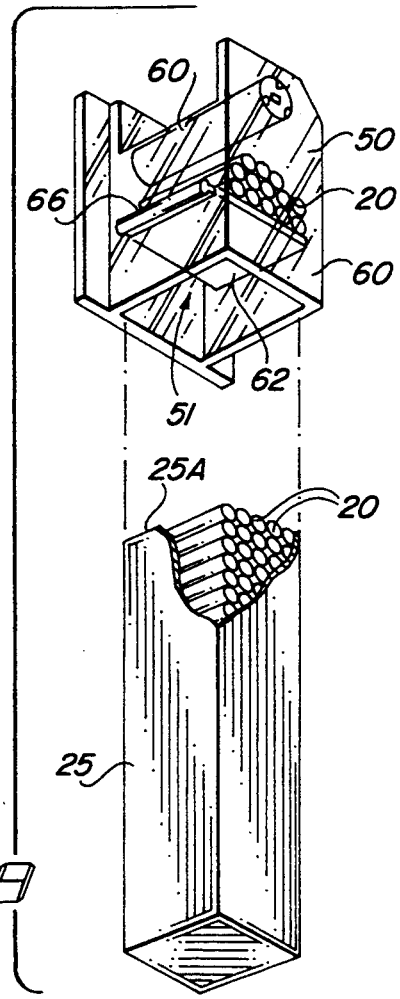
FIG. 9-Perspective view of a slidable, invertable hopper that receives a manufacturer's cigarette container to be loaded into the vending machine.

As shown in FIGS. 2 and 3, each vendor 28 has a removable hopper 50 for loading and holding individual cigarettes 20 (i.e. cigarettes may be tubed or untubed) directly from a manufacturer's cigarette container 25 (i.e. FIG. 9). The individual cigarettes 20 are tubed in an individual, single, rigid, plastic, elongated tube package which is sufficiently airtight to maintain freshness and is capped closed at both ends (as best seen in FIG. 6), and then placed into the cigarette manufacturer's original container 25 for shipment to vendors. This process of tubing individual cigarettes 20 is done separately and outside of vending machine 10, and it is done prior to loading the original containers into the vending machine 10. As stated earlier, this tubing process will not be described in this application since it is described in applicant's parent copending patent application entitled "PROCESS AND APPARATUS FOR AUTOMATICALLY INSERTING CIGARETTES INTO PLASTIC TUBES" Ser. No. 08/138,459 filed by Mr. Ronald Laidlaw on Oct. 15, 1993.

As further seen in FIGS. 2 and 3, brackets 150 are mounted to back plate 32 through the use of mounting screws 155. The brackets 150 are aligned so that the hopper 50 can fit between side supports 34. Hopper 50 is mounted to machine 10 by sliding sides 151 of hopper 50 through the brackets 150, and hopper 50 slides downwardly to sit on shelf 40.

Hopper 50 is designed to hold a stock of individual cigarettes 20. The hopper 50 can be refilled by sliding it upwardly through brackets 150. A floor 62 may be inserted through mounting slots 64 located on the vertical wall 60 of the hopper 50 above any tubed cigarettes 2 that still remain within hopper 50 and prevents them from falling out when hopper 50 is inverted for loading.

Hopper 50 is entirely removed from the machine 10 and is inverted as shown in FIG. 9. One end 25A of original manufacturers container (i.e. a carton or package) 25, which holds individual cigarettes 20 (i.e. cigarettes may be tubed or untubed) is removed, and the container 25 is inserted into central portion 51 of hopper 50 so that it abuts the floor 62. Hopper 50 is then turned right side up. Floor 62 is then removed. Hopper 50 may then be returned to its position in the machine 10 by sliding it down into brackets 150 and resting on shelf 40. As shown in dotted lines in FIG. 2, the containers 25 remain in the hopper 50 so that the individual cigarettes 20 can be directly dispensed from them.

Figure 8:
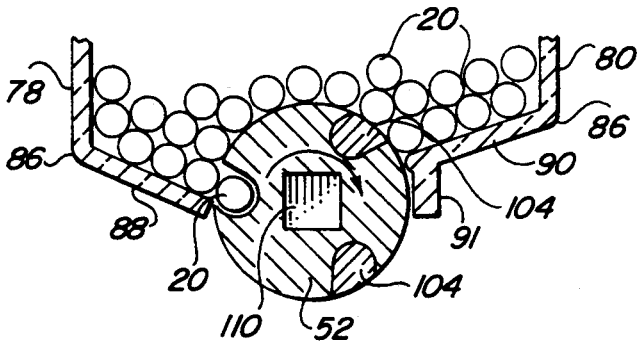
FIG. 8-Front side view showing the cooperation between a hopper and a dispensing member.
Figure 5:
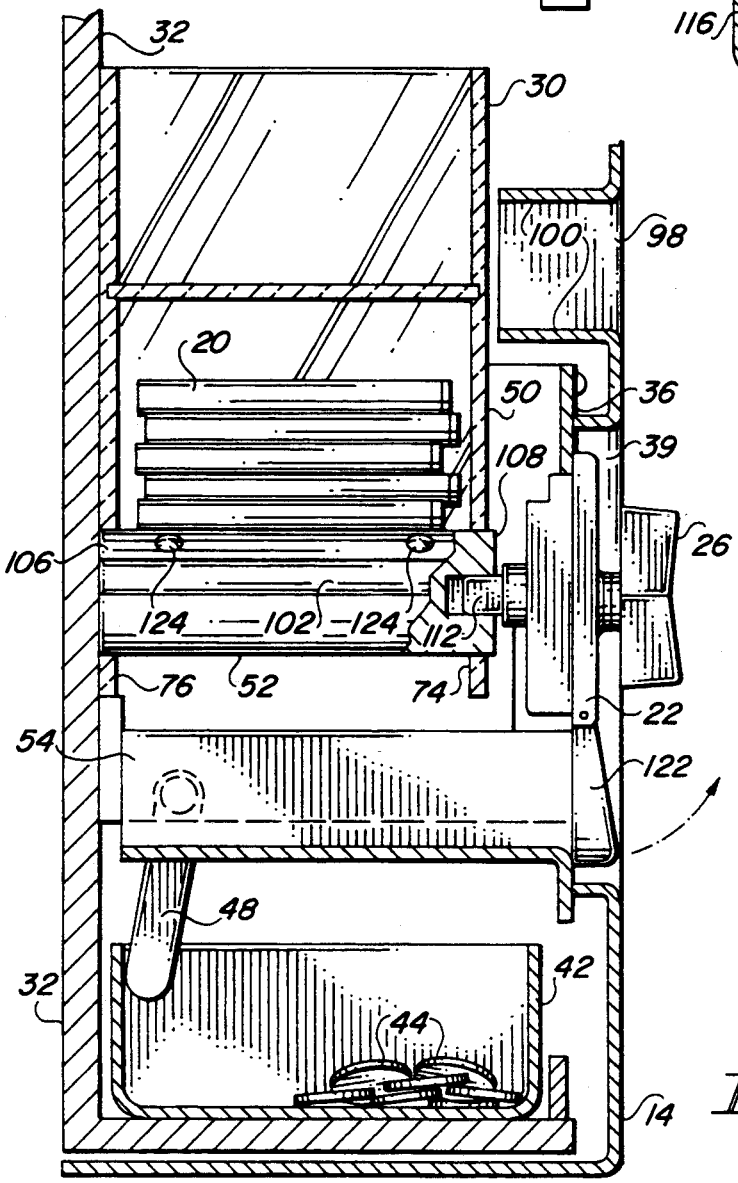
FIG. 5-Cross sectional side view of the preferred embodiment vending machine.

As shown in FIG. 2, slots 64 are positioned in sidewalls 60 of hopper 50 such that floor 62 slides horizontally across hopper 50. Floor 62 has a handle 66 for use in inserting and removing it. Floor 62 slides in above individual cigarettes 20 which remain in a proper horizontal orientation. Before hopper 50 is placed entirely between side surfaces 34 and onto shelf 40, floor 62 slides out from slots 64 of the hopper 50. Since floor 62 slides horizontally, individual cigarettes 20 tend to fall into hopper 50 in a horizontal orientation. Floor 62 generally slides in a direction perpendicular to the axes of individual cigarettes 20 and capped end 56 and capped end 58 (FIG. 6) of cigarettes 20 fall simultaneously into hopper 50 so that individual cigarettes 20 maintain their horizontal orientation (FIGS. 2, 5, 8). The alignment of individual cigarettes 20 is not affected by the minor jostling of vending machine 10 or hopper 50.

This loading process may be repeated for each of the hoppers 50 in machine 10 until all of the hoppers 50 have been filed with individual cigarettes 20. After all of the hoppers 50 have been loaded by the use of this process, a container 25 remains inserted in each hopper 50 (i.e. shown in dotted lines in FIG. 2) while outer casing 14 is placed back on vending machine 10.

Figure 7:
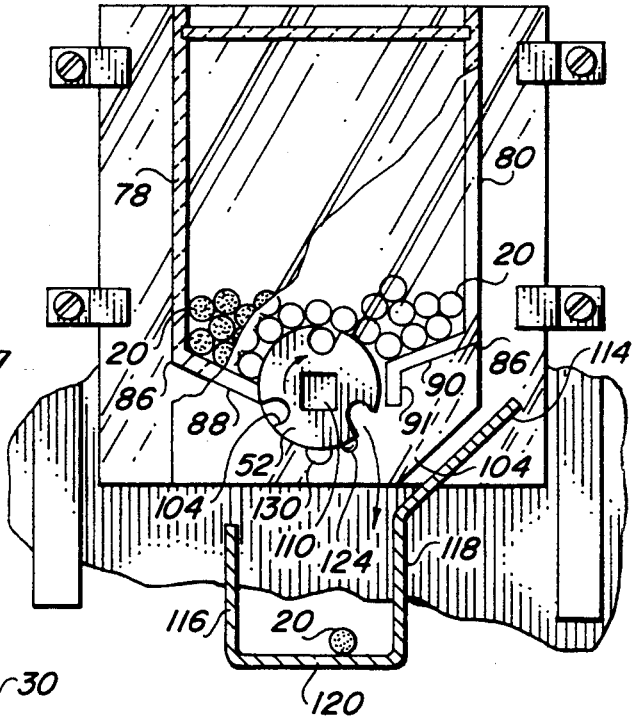
FIG. 7-Cross sectional front view of a single vendor from the vending machine.

FIG. 5 shows a cross sectional side view of vending machine 10, and FIG. 7 shows a cross sectional front view of a single vendor 28 from vending machine 10. Referring to FIGS. 2–3 and 5–6, each hopper 50 includes front and back walls 74 and 76 respectively, rigid left and right side walls 78 and 80 respectively, and bottom walls 88 and 90. Sidewalls 78 and 80 terminate at an edge 86 which substantially parallels the direction of orientation for cigarettes 20 within hopper 50. At edges 86, bottom walls 88 and 90 extend downwardly and inwardly with respect to hopper 50.

Bottom walls 88 and 90 terminate adjacent to dispensing member 50. Preferably, bottom walls 88 and 90 terminate with only a few thousandths of an inch to dispensing member 52 to restrict air movement between walls 78 and 80 and dispensing member 52. The restricted air movement preserves cigarette freshness. Of course, such a narrow clearance also prevents individual cigarettes 20 from falling out of hopper 60 between walls 88 and 90 and dispensing member 52. The precise positioning of dispensing member 52, which is preferably centered sideways near the bottom of hopper 50, is determined by openings 92 and 94 which reside in front and back vertical walls 74 and 76, respectively. Preferably, dispensing member 52 resides in a substantially horizontal orientation, paralleled to the same orientation of individually cigarettes 20.

Walls 74, 76, 78 and 80 of hopper 50 are constructed from a smooth, rigid, transparent plastic material and the smoothness of these walls allow tubed cigarettes to fall vertically and be fed within hopper 50. As seen in FIG. 1, the transparent front wall 74 allows tubed cigarettes 20 to be seen through viewing window 18, which is located in an opening 98 of outer casing 14. The transparent front wall 74 permits observation of cigarettes 20 from outside outer casing 14. As shown in FIG. 5, openings 98 has inner walls 100 so that only the cigarette levels of each vendor 28 can be seen by the observer, and no other components of vending machine 10 are visible.

Dispensing Member

Figure 4:
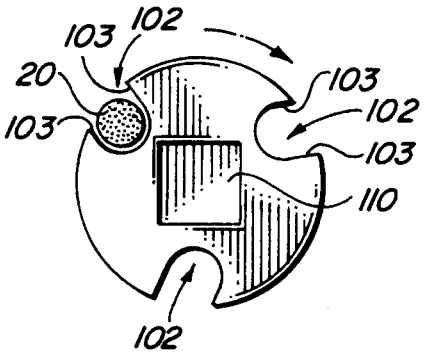
FIG. 4-Front view of the dispensing member by itself.

Referring to FIGS. 3 and 4, dispensing members 52 has an elongated, generally cylindrical shape. Dispensing member 52 typically has a diameter of $1\frac{1}{2}$ inches and a length of around 5 inches in the preferred embodiment. A plurality of slots 102 may be formed in an outer cylindrical surface 104 of dispensing member 52. In FIG. 4, dispensing member 52 is shown to have three slots 102. Alternatively, a single slot 102 instead of a plurality of slots may be formed in the outer cylindrical surface 104. Each slot 102 extends axially for the entire length of member 52 in a individual direction substantially parallel to the orientation of tubed cigarettes 20 within hopper 50.

One advantage of the present invention is that it can be adapted to dispense either a single cigarette or a multiple number of cigarettes for each turn of the coin machine.

As seen in FIG. 7 and 8, dispensing member 52 is shown to have a multiple number of (i.e. three) slots 102. Two of the slots 102 have a slug 104 inserted into them so that only one tubed cigarette 20 is dispensed for one turn of the coin mechanism 22 (i.e. one cigarette vended for one coin inserted). Machine 10 can be adapted to dispense a number of tubed cigarettes 20 for each turn of the coin mechanism 22 (i.e. two or three cigarettes for one inserted). Machine 10 is easily adapted for multiple dispensing simply by removing some of the slugs 104 and leaving the desired number of open slots 102, which would correspond to the desired number of cigarettes dispensed for each turn of the coin mechanism 22.

Referring to FIGS. 4 and 7, each slot 102 is designed to loosely hold an individual tubed cigarette 20 in which its entire diameter is contained within slot 102. Thus, an individual tubed cigarette 20 enters a slot 102, the cigarette 20 may be moved past lower wall 90 of hopper 50. The size of slot 102 is sufficiently small to prevent two cigarettes from being held therein or from jamming.

FIG. 8 shows a front view depicting the cooperation between hopper 50 and dispensing member 52 and FIG. 4 shows a front view of dispensing member 52 by itself. FIG. 6 shows a partial perspective view of dispensing tray 54 and a back side of coin mechanism 22. Referring to FIG. 4 each slot 102 has opposing wall 103 that are each offset from a radial direction for dispensing member 52. In particular, walls 103 are offset from a radial direction by an acute angle in the direction of rotation for dispensing member 52. Referring to FIGS. 7 and 8, this offset allows an individual cigarette 20 to enter slot 102 at the earlier possible moment when dispensing member 52 is rotated so that slot 102 is above lower left wall 88 and to prevent jamming potentially caused by having a cigarette 20 fall out of slot 102 as slot 102 rotates to a position near lower right wall 90.

As shown in FIG. 3, a back end 106 of dispensing member 52 abuts back plate 32 to prevent backwards axial movement of dispensing member 52. A front end 108 of dispensing member 52 has a socket 110 formed therein. Referring to FIGS. 3, 5, and 6, socket 110 mates with a corresponding plug 112 of coin mechanism 22, coin mechanism 22 prevents forward axial movement of dispensing member 52. Despite the blocked axial movement, dispensing member 52 is still free to rotate within openings 92 and 94 located in the walls 74 and 76 of hopper 50.

Referring to FIGS. 3, 5 and 6, the rotation of dispensing member 52 is controlled by coin mechanisms 22. Until a coin 44 is inserted into coin mechanisms 22, neither coin mechanism 22 nor dispensing member 52 is able to rotate. Coin mechanisms 22 may be adapted to receive tokens instead of coins 44. One advantage of using tokens is that the tokens would have to be purchased prior to using the machine 10 and the requirement of purchasing these tokens would allow the sale of the cigarettes from machine 10 to be regulated and would prevent the sale of cigarettes to minors.

Another advantage of using tokens is that it makes the machine independent of the currency used and this advantage makes the machine more marketable in other countries. Socket 110 and plug 112 are mutually configured so that prior to the insertion of a coin 44 in coin machine 22, slot 102 is locked at the portion illustrated in FIG. 8 (i.e. the left most slot 102 is located above the left lower wall 88 of hopper 50). This position is the loading position for dispensing member 52. Under normal operations of machine 10, a cigarette 20 falls into slot 102 in preparation of being dispensed.

Referring to FIGS. 4, 7, and 8, after a coin 44 is inserted into coin mechanism 22, coin mechanism 22 unlocks, and a customer turns handle 26 (i.e. clockwise as indicated by the arrow in FIG. 4, 7, and 8). Upon turning handle 26, dispensing member 52 rotates. When dispensing member 52 reaches the position shown in FIG. 7, the cigarette 20 is unloaded. Prior to unloading, the cigarette 20 is directed between an extension wall 91 attached to the lower portion of wall 90 and the dispensing member 52. The cigarette 20 is directed towards extension wall 91 so that the dispensing member 52 must be rotated past the wall 91 in order for the cigarette 20 to be dispensed. The extension wall 91 in effect, prevents the vending of cigarettes 20 when additional coins 44 have not been inserted into the machine 109. Wall 91 prevents dispensing cigarettes 20, for example, by rotating coin mechanism 22 back and forth to pick up and dispense cigarettes repeatedly without putting in another coin. At the unloading position, slot 102 resides just below extension wall 91 of hopper 50, and cigarette 20 falls from slot 102. The rotation is past the point at which mechanism 22 is locked and cannot be turned counterclockwise. Instead it must be turned clockwise to its starting position and another coin inserted to obtain another cigarette.

As shown in FIG. 7, cigarette 20 falls from slot 102 onto the inclined wall 114 of dispensing tray 54. As shown in FIG. 7, dispensing tray 54 includes left and right vertical walls 116 and 118 respectively, which extend upwardly from opposing edges of a generally horizontal floor 120. Inclined wall 114 resides at the upper end of wall 118 and extends upwardly and diagonally until it nears right vertical wall 80 of hopper 50.

As the customer continues to rotate handle 26, an individual cigarette 20 rolls downwardly on inclined wall 114 towards the interior of dispensing tray 54. As shown in FIG. 6, cigarette 20 rolls to floor 120 of dispensing tray 54, and left wall 116 blocks it from moving any further. Coin 44 exits coin mechanism 22 and falls to the left of wall 116, as shown by the arrows in FIG. 6, into coin box 42. After the complete rotation of handle 26, coin mechanism 22 returns to its locked position, where slot 102 resides above lower left wall 88 of hopper 50 and another tubed cigarette 20 falls into slot 102. As shown in FIG. 2, the customer opens hinged door 122 to remove cigarette 20 from dispensing tray 54 through opening 39 in outer casing 14.

FEATURES FOR RELIABLE AND PROPER FEEDING OF CIGARETTES INTO THE DISPENSING MACHINE

Hopper 50 and dispensing member 52 include several features with promote the reliable feeding of cigarettes 20 into slot 102.

1. Non-Integral Distance

As shown in FIGS. 7 and 8, left and right lower side walls 88 and 90 of hopper 50 are designed so that the distance along walls 88 and 90 between dispensing member 52 and lower ends 86 are substantially different than an integral number of average cigarette diameters. In the preferred embodiment, this distance is between $3\frac{1}{8}''$ and $3\frac{3}{4}''$ cigarette diameters. With this distance being a non-integral number of cigarette diameter, the row of cigarettes which resides immediately above the lowest row of cigarettes 20 within hopper 50 tends not to ride precisely on top of the lowest row of cigarettes. Rather, they come to rest a significant distance above and to the side of the lower row of cigarettes. Consequently, the downwardly pressure exerted on the lowest row by all cigarettes above has a substantial sideways component to it, and this sideways component directed tube cigarettes 20 towards slot 102.

2. Agitators

As shown in FIGS. 3 and 5, dispensing member 52 includes agitators 124 which cause cigarettes 20 within hopper 50 to rise and fall through a camming action as dispensing member 52 rotates. Agitator 124 are bumps that increase the radius of dispensing member 52 where they are located. Agitators 124 reside in a line generally parallel to the orientation of cigarettes 20 within hopper 50, and they are at least located near each slot 102 that is used to dispense a tubed cigarette 20. Agitators 124 are symmetrically placed along dispensing member 520 so that an entire cigarette 20 and not only one end of cigarette 20 is lifted by agitator 24 as dispensing member 52 rotates. Agitators 124 are located before slot 102. In relative to the direction of rotation of dispensing member 52, cigarettes 20 are agitated by the rising and falling over the bumps of agitation 24, and this agitation causes cigarette 20 to fall immediately in front of slot 102. This agitation also causes momentum which propels a cigarette 20 into an empty slot 102.

Agitators 124 have a height approximately equivalent to $\frac{1}{2}$ of an average cigarette diameter. As shown in FIG. 7, a notch 130 at the front of opening 92 of hopper 50 accommodates agitator 124 during assembly of vending machine 10. Moreover, in FIG. 3, notches 132 in lower left and lower right walls 88 and 91 accommodate agitators 124 during rotation of dispensing member 52. As seen in FIG. 3, notches 132 permit agitators 124 to pass through walls 88 and 91 as dispensing member 52 rotates.

Preferably, each of agitators 124 along dispensing member 52 is separated by a short distance. This distance is shorter than an average cigarette length so that the agitation of cigarette 20 is effective.

The amount of physical contact between dispensing member 52 and cigarettes 20 within hopper 50 is maximized by the dispensing member 52 having a maximum arc, which is equal to 180° minus the arc distance of the open to slot 102. By maximizing the amount of contact between dispensing member 52 and tubed cigarettes 20 in hopper 50, a maximum amount of agitation of cigarettes 20 occurs as dispensing member 52 rotates, and this agitation improves the dispensing of cigarettes 20 by maximizing the direction of tubed cigarettes 20 to slot 102 preventing them and from getting jammed elsewhere near hopper 50.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed:

1. A coin-operated cigarette vending machine comprising:

a support plate;

at least one pair of brackets mounted to the support plate;

a hopper slidably received in the at least one pair of brackets;

a cigarette manufacturer's original cigarette carton in which tubed cigarettes are loaded in a horizontal orientation received in the hopper and having an open side;

a rotatable dispensing member mounted in the hopper in the horizontal orientation for receiving tubed cigarettes from the open side of the carton and for dispensing the individually tubed cigarettes;

a coin mechanism coupled to the dispensing member for generally locking its rotation and for allowing it to be rotated once when a required number of coins or tokens are inserted into the mechanism; and a collection area for holding and securing the coins or tokens inserted into the machine.

2. The vending machine according to claim 1 further comprising:

additional hoppers, dispensing members, and coin mechanisms for vending additional tubed cigarettes.

3. The vending machine according to claim 1 further comprising:

an outer casing for enclosing and securing the hopper and the dispensing member having an opening through which the coin mechanism extends and further having an opening for observing the tubed cigarettes remaining inside the vending machine.

4. The vending machine according to claim 1 further comprising:

a dispensing tray located underneath the dispensing member for receiving and holding the tubed cigarettes after they have been dispensed.

5. The vending machine according to claim 4 wherein:

the dispensing tray has an inclined wall located underneath the dispensing member for receiving the tubed cigarettes.

6. The vending machine according to claim 1 wherein the hopper comprises:

a back vertical wall having side edges which are slidably received by the at least one pair of brackets;

a front vertical wall;

a pair of side vertical walls, each wall having a slot;

a hopper floor insertable into the hopper slots for retaining any remaining tubed cigarettes in the hopper when the hopper is removed for re-loading tubed cigarettes into the hopper in the horizontal orientation;

a pair of bottom slanting walls for holding and allowing tubed cigarettes to fall towards the dispensing member; and a pair of hopper openings, one opening being located in the front wall and the other opening being located in the back wall in which is rotatably supported the dispensing member.

7. The vending machine according to claim 6 wherein:

the dispensing member having at least one axial slot whereby the slot is rotated above one bottom slanting wall to receive a tubed cigarette and is further rotated past the other bottom slanting wall to dispense the tubed cigarette.

8. The vending machine according to claim 7 wherein the hopper further comprises:

an extension depending from the other bottom slanting wall past which the cigarette to be vended must be rotated in order to fall out of the dispensing member slot thereof preventing dispensing multiple cigarettes without inserting additional coins.

9. The vending machine according to claim 1 wherein:

the dispensing member having a cylindrical surface in which is disposed at least one axial slot for dispensing at least one tubed cigarette for each rotation of the coin mechanism.

10. The vending machine according to claim 9 wherein:

each slot has two walls extending from an outer surface to an inner surface of the dispensing member wherein the walls are offset by an acute angle from a radial direction that is in the direction of rotation of the dispensing member.

11. The vending machine according to claim 9 wherein:

the dispensing member having a plurality of axial slots within its surface for receiving and dispensing a plurality of tubed cigarettes for each rotation of the coin mechanism.

12. The vending machine according to claim 11 wherein the dispensing member further comprises:

slugs insertable into a number of axial slots for plugging those slots and adapting the dispensing member so that a desired number of axial slots still remain open to receive and dispense a corresponding desired number of tubed cigarettes for each rotation of the coin mechanism.

13. The vending machine according to claim 12 wherein:

the plurality of axial slots is three slots;

the number of slots plugged with a slug is two slots; and the number of slots still remaining open to receive and dispense tubed cigarettes is one slot.

14. The vending machine according to claim 9 wherein the dispensing member further comprises:

agitators located near the axial slots for agitating the tubed cigarettes in the hopper so that they are directed towards the slots and away from any other undesired areas.

15. The vending machine according to claim 14 wherein:

the agitators are bumps located on the surface of the dispensing member for providing a raised surface at these areas on which the tubed cigarettes contact so that they are agitated.

16. The vending machine according to claim 1 further comprising:

the coin mechanism adapted for receiving a token of unique design before the mechanism will be unlocked and vend a tubed cigarette.

17. The vending machine according to claim 1 further comprising:

a hopper floor which is engaged in a slot in each sidewall of the hopper and is removed by sliding it in a direction perpendicular to a lengthwise axis of the tubed cigarettes so that during reloading the tubed cigarettes fall in the proper horizontal orientation and do not tumble in any other direction.

18. A method for vending cigarettes from a coin-operated vending machine comprising the steps of:

supporting in the vending machine a hopper adapted for holding tubed cigarettes in a horizontal orientation;

removing the hopper from the machine;

inserting into the hopper an open end of an original container in which the cigarettes were purchased containing a plurality of tubed cigarettes;

reinserting the hopper, container and tubed cigarettes into the machine; and dispensing directly from the container a predetermined number of tubed cigarettes via a dispensing member for each rotation of a coin mechanism which is rotatable only when a required number of coins or tokens is inserted into the coin mechanism.

19. The method for vending tubed cigarettes according to claim 18 wherein the step of dispensing a predetermined number of tubed cigarettes further comprises the steps of:

providing a dispensing member having a plurality of slots for receiving and dispensing a desired number of tubed cigarettes; and adapting the dispensing member so that a desired number of slots remain open for receiving and dispensing the desired number of cigarettes for each rotation of the coin mechanism.

20. The method for vending tubed cigarettes according to claim 19 wherein the step of adapting the dispensing member further comprises the step of:

inserting slugs into some of the slots so that the desired number of slots in the dispensing member remains unobstructed.

21. The method for vending tubed cigarettes according to claim 18 further comprising the step of:

agitating the tubed cigarettes in the hopper so that the cigarettes are directed toward the slots and away from any other undesired areas.

22. The method for vending tubed cigarettes according to claim 18 wherein the step of dispensing a predetermined number of tubed cigarettes further comprises the step of:

inserting at least one required token into the coin mechanism so that the dispensing member can be rotated to dispense at least one tubed cigarette.

23. The method of claim 18 wherein:

the supporting step includes supporting the hopper right side up in the machine the container inserting step includes first inverting the removed hopper, and the reinserting step includes first turning the hopper right side up.

24. The method for vending cigarettes from a coin operated vending machine according to claim 23 further comprising the steps of:

prior to inverting the hopper, inserting a hopper floor into the hopper above any remaining tubed cigarettes in the hopper; and removing the floor prior to the reinsertion step.

* * * * *